United States Patent [19]

Lawrence

[11] Patent Number: 5,005,813

[45] Date of Patent: Apr. 9, 1991

[54] RAPID ACTION CAM-LOCK CLAMP

[76] Inventor: Joseph W. Lawrence, R.D. 4, Box 184, Saegertown, Pa. 16433

[21] Appl. No.: 523,420

[22] Filed: May 15, 1990

[51] Int. Cl.[5] ..... B25B 1/24

[52] U.S. Cl. ..... 269/236; 269/287; 269/902

[58] Field of Search ..... 269/902, 156, 164, 80, 269/287, 283, 236, 249; 51/216 R; 409/220; 82/40 R, 45

[56] References Cited

U.S. PATENT DOCUMENTS

| | | | |
|---|---|---|---|
| 685,078 | 10/1901 | Willringhaus | 269/164 |
| 1,497,107 | 6/1924 | Lasell | 269/164 |
| 2,343,699 | 3/1944 | Petersen . | |
| 2,421,200 | 5/1947 | Hall . | |
| 2,454,309 | 11/1948 | Davis | 269/236 |
| 2,627,113 | 2/1953 | Moray | 269/249 |
| 2,682,694 | 7/1954 | Kempkes . | |
| 2,908,303 | 10/1959 | Schmidt | 269/236 |
| 3,358,990 | 12/1967 | Anton . | |
| 4,139,189 | 2/1979 | Wietrzyk | 269/902 |
| 4,191,367 | 3/1980 | Speiser et al. | 269/283 |
| 4,201,376 | 5/1980 | Philips . | |
| 4,398,706 | 8/1983 | Kaulfuss | 269/156 |

OTHER PUBLICATIONS

American Machinist, p. 143, "Practical Ideas," Dec. 5, 1946.

*Primary Examiner*—Robert C. Watson

*Attorney, Agent, or Firm*—Edward W. Goebel, Jr.

[57] ABSTRACT

A rapid acting adjustable clamp includes a precision ground dovetail track which carries a cam actuated locking assembly along a bridge portion of the clamp to provide quick initial setup, secure workpiece retention, quick release, and highly repeatable subsequent re-actuation of the clamp. The resulting positive acting clamp is particularly advantageous for use in precision grinding, milling, and electron discharge machining operations where a number of similar workpieces are to be machined. The dovetail joint provides rapid sliding adjustment along a first workpiece engaging axis while a single threadedly adjustable screw provides rapid setup along an orthogonal workpiece engaging axis. The combination of these quick adjustments with the single lever cam locking actuation greatly reduces the number of repetitive operator manipulations required in its use, resulting in significantly improved clamping action and in increased productivity by its use.

19 Claims, 2 Drawing Sheets

FIG. 1
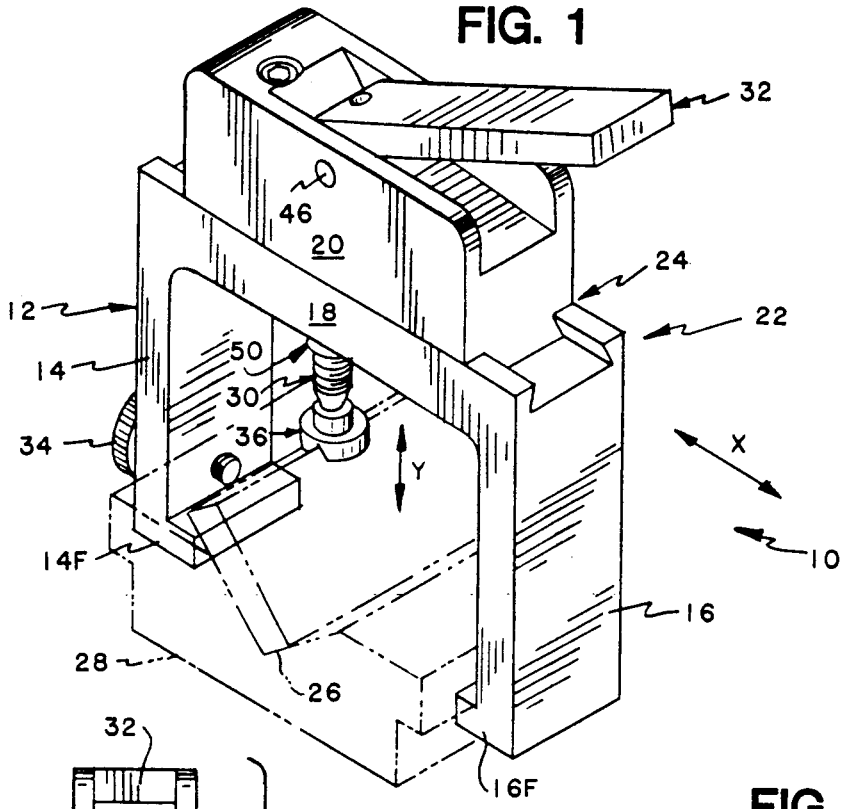
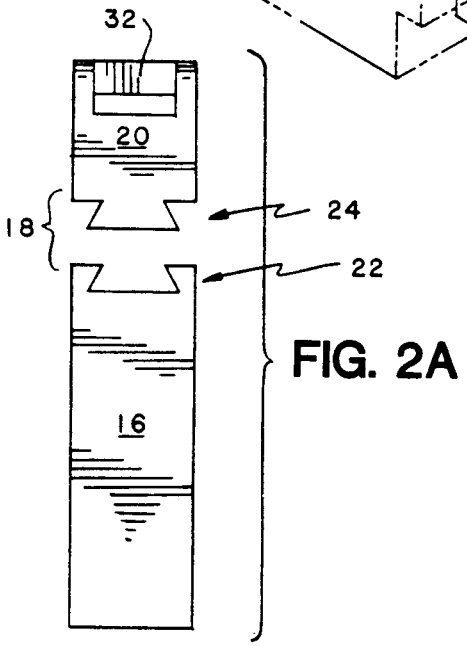
FIG. 2A
FIG. 3
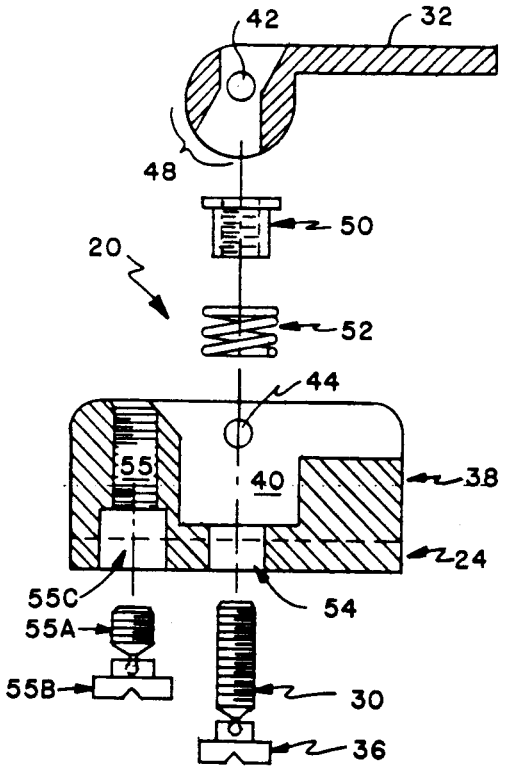
FIG. 2B
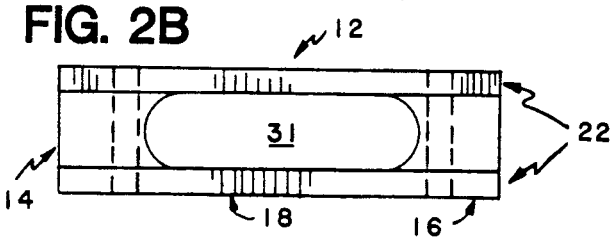

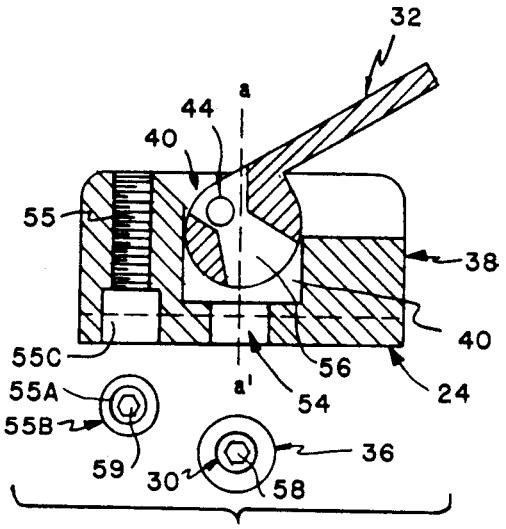
FIG. 4
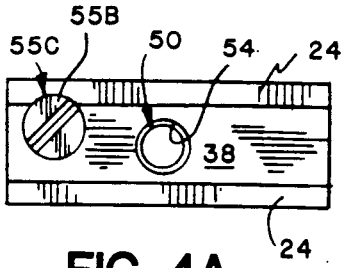
FIG. 4A
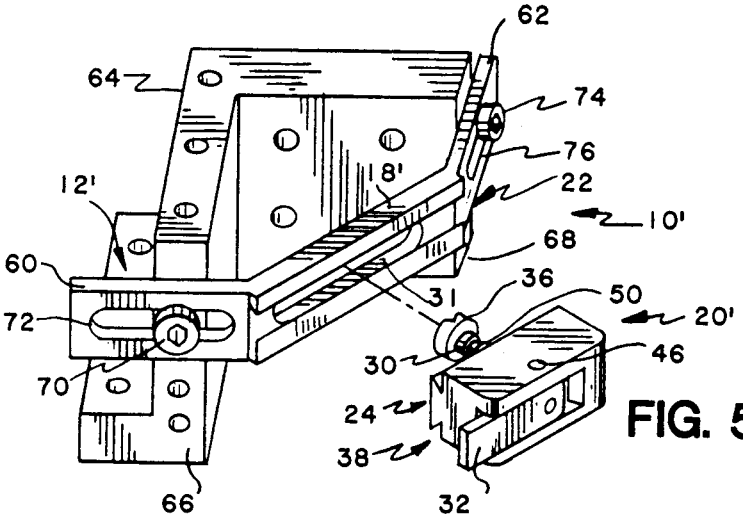
FIG. 5
FIG. 5A
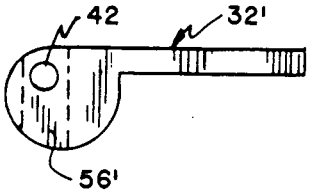
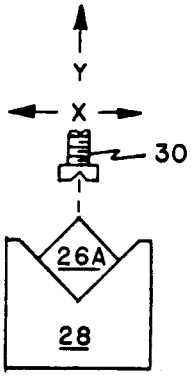
FIG. 6A
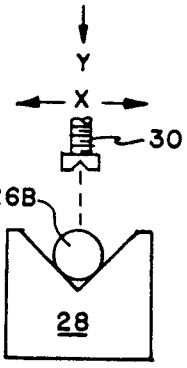
FIG. 6B
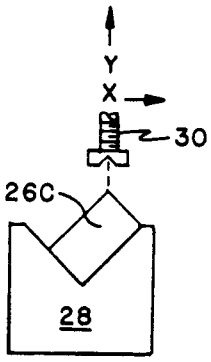
FIG. 6C
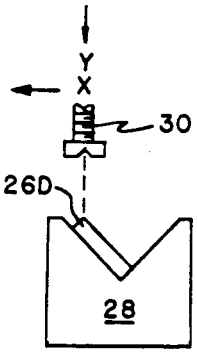
FIG. 6D

RAPID ACTION CAM-LOCK CLAMP

BACKGROUND OF THE INVENTION

1. Field of the Invention

The present invention relates generally to adjustable clamps for holding workpieces during various machining operations, and more particularly to a rapid acting clamp which employs a quick set/quick release cam carried by a sliding dovetail joint to improve its clamping action.

2. Description of the Prior Art

Devices for securely retaining workpieces during machining operations are well known in the machining arts, and have a long history of development. Over the years a great deal of inventive energy has been devoted to devices for holding workpieces, and basic V-blocks and related holding structures, continue to be among the most utilized due to their versatility and ruggedness. Similarly, a wide array of clamping devices have been developed for rigidly retaining the range of workpiece sizes and shapes in their associated V-blocks. A number of U.S. Patents teach methods and apparatus for clamping workpieces in V-blocks, or similar workpiece holders, and are reflective of the amount of ingenuity which this field has attracted. Generally, these prior art clamping devices have employed a plurality of threaded screws to bear against a like plurality of workpiece surfaces to anchor it in its associated V-block. For example, U.S. Pat. No. 4,201,376 to Philips discloses an adjustable clamp which includes an array of three threadedly adjustable clamping screws, two or more of which are manually screwed down to engage the workpiece surfaces. The unused screw is presumably moved out of the way, and two of these three screw members are movable in slots to provide a measure of flexibility in their workpiece engaging adjustments.

In another U.S. Pat. No. 3,358,990 to Anton, there is disclosed an earlier V-block clamp employing a pair of threadedly adjustable screw members carried by structures permitting a degree of slideable adjustment. As with the '990 patent described above, two of the three screw members are adjusted to engage two distinct surfaces of the workpiece.

In the December 1946 edition of what appears to be the American Machinist Magazine, a simplified cousin of the screw down V-block clamps described in aforementioned two U.S. Patents is pictured. As illustrated there, the simpler device employs a single screw down member carried by a slideable member to achieve its workpiece holding action.

These prior art clamping devices, and others, operate more or less well and have found wide usage within the nation's machine shops. Virtually all of these prior art devices, however, require a multiplicity of individual adjustments to intially clamp the workpiece in position, and a like multiplicity of reverse steps to release the workpiece on completion of the desired machining. The same sequence of manipulations must be carried out for each and every workpiece to be handled. When used in one-of-a-kind machining applications, these repetitive steps are merely a time consuming inconvenience. But, when used where a significant number of similar workpieces are to be machined—a very common situation in small to medium size production machine shops—the loss in man hour productivity is significant. This loss leads to undesirably high unit costs for the finished articles, and represents poor utilization of a skilled machinist's time, not to mention the expensive milling/grinding machine time lost. It's not difficult to see that devices as basic as a workpiece clamp can make a major contribution to overall machining efficiency, and so setup times are constantly under scrutiny to avoid losses incurred by needless repetitive steps. Therefore, it is clear that a continuing need exists for a quick acting clamp which will provide reliable and positive clamping action while greatly reducing the time required to initially set up the clamp; apply and tighten the clamp members; thereafter releasing the clamp; and subsequently preparing the clamp/V-block for the insertion of the next workpiece. The improved quick action cam-lock clamp taught in the present invention admirably meets these needs with great precision.

SUMMARY OF THE INVENTION

It is therefore a primary object of the present invention to provide an improved clamp for holding workpiece which will overcome the disadvantages of the prior art devices.

A further object of the present invention is to provide a rapid acting clamp which will allow the desired secure workpiece clamping action while greatly reducing the number of operator manipulations needed for its use.

A yet further object of the present invention is to provide a rapidly adjustable workpiece clamp having a precision dovetail joint for slideably adjusting the workpiece engaging member along a first adjustment axis, and a threadedly settable member for adjustment along a second orthogonal adjusting axis.

A still further object of the present invention is to provide a cam actuated assembly for carrying the workpiece engaging member to afford rapid setting and releasing of the clamp.

A still further object of the present invention is to provide a rapid acting clamp ideally suited for holding/releasing each of a succession of similar workpieces by retaining the initial workpiece engaging member settings to quickly engage subsequent workpieces after quick release of the previous workpiece.

By means of basic and alternate embodiments, the present disclosure teaches the use of a unique combination of structures to implement a cam lever actuated setting/locking/releasing mechanism which transforms the well known V-block clamp into a very rapid acting device. The structures include a precision ground dovetail track which allows slidable adjustment of a cam lock assembly, and enables the interaction between the cam and a threadedly adjustable element to greatly reduce the time needed for its operation. By virtue of the single lever actuated cam lock assembly carried as part of the precision dovetail track, and a small threaded workpiece engaging member, very quick initial set up times in an X-Y clamping plane are accomplished. Suitable choice of the cam clamping distance assures both secure workpiece retention (after initial set up) and the clearance needed for workpiece removal on completion of the machining steps.

BRIEF DESCRIPTION OF THE DRAWINGS

Additional objects and advantages of the invention will become apparent to those skilled in the art as the description proceeds with reference to the accompanying drawings wherein:

FIG. 1 is a perspective view of a rapid acting cam-lock clamp according to the present invention;

FIGS. 2A and 2B show, respectively, a simplified side view and a simplified top view of the base member of the rapid acting cam-lock clamp;

FIG. 3 is an exploded side view, partly in section, of the various components of the cam-lock assembly;

FIG. 4 is a highly schematic view of selected components, partly in section, of the cam-lock assembly;

FIG. 4A is a bottom view of the cam-lock assembly of FIG. 4.

FIG. 5 is a perspective view of an alternate embodiment of a rapid acting cam-lock clamp according to the present invention;

FIG. 5A is a side view of an alternate embodiment of a cam lever for use with a cam-lock assembly; and FIGS. 6A–6D are schematic drawings illustrating several common workpiece cross-sections and the adjustments of their associated workpiece engaging members in the X-Y clamping plane.

DETAILED DESCRIPTION OF THE PREFERRED EMBODIMENTS

Referring now to FIG. 1, there is shown a perspective view of the improved rapid acting adjustable clamp according to the present invention. By way of a brief overview, a preferred embodiment of the clamp 10 includes a base member 12 having a pair of leg portions 14 and 16 symmetrically positioned astride a central bridge portion 18, and a sliding cam lock assembly 20 adapted to coact with the base 12. The cam-lock assembly 20 is arranged to slide smoothly along the length of the bridge 18 by virtue of a precision track employed to retain the two. While a T-slot or similar precision track can be employed in accordance with my invention, the dovetail track of the preferred embodiment offers special advantages as explained below. The track consists of a female dovetail element 22 precision ground along the upper face of the bridge 18, and a male dovetail element 24 precision ground along the lower face of the cam lock assembly 20. Brief reference to the simplified side view of FIG. 2A illustrates the relative dimensions and positioning of these dovetail elements with the female dovetail track 22 topping the leg 16 along the bridge portion 18, and the male dovetail track 24 bottoming the cam-lock assembly 20 shown separately. The clamp 10 is shown in use, ready to securely clamp a workpiece 26 into an associated V-block 28 by means of an adjustable holding screw 30 under the action of a manually operated cam lever 32. The V-block 28 is, in turn, retained in the clamp 10 by a pair of inwardly facing feet 14F and 16F formed into the lower portions of their respective legs 14 and 16, which feet engage correspondingly shaped notches in the V-block 28. Further rigidity of this retention is provided by means of a thumb screw 34 bearing firmly on one side of the V-block 28.

As described in detail below, greatly improved clamping action is afforded by the unique interaction of elements of the clamp 10. In particular, rapid and precise positioning of the holding screw 30 on the workpiece 26 is accomplished along the X-axis (depicted by the X arrow) by sliding the cam lock assembly 20 along the bridge 18, and along the Y axis (depicted by the Y arrow) by the action of adjustable screw 30 in combination with the cam locking action resulting from the actuation of cam lever 32. Note that in the 'in progress' action of the clamp 10 of FIG. 1 that the X position of the holding screw 30 is shown, illustratively, to the left of the center of the bridge portion 18; and that the Y position of the bottom of the holding screw 30, capped with a ball type swivel head 36, is shown at approximately half of the height of the legs 14 and 16 Of course, workpieces at all other X and Y positions in the clamping plane thus defined may be similarly accessed.

FIG. 3 shows an exploded view, partly in section, of the cam-lock assembly 20. A cam body 38 includes a central cavity 40 for housing the pivotal cam lever 32 via a pair of dowel holes 44, each located on one side of the cam body 38, and a corresponding pair of pivot pins 46 (one of which is shown in FIG. 1). The pivot pins 46 each extend through the dowel holes 44 on the sides of the cam body 38 and into a cam hole 42 on each side surface of the portion of cam lever 32 which forms an interior cavity 56, thereby retaining the cam lever 32 in place. The pivot pins 46 do not extend into the interior of cavity 56 so as to allow an appropriate tool to pas through the cavity 56 for ease of adjustment of the holding screw 30.

A camming surface 48 bears against an upper flange of an internally threaded bushing 50 fitted within a coil spring 52. With the cam lever 32 pinned into position, the bushing 50 fits into, and its lower end may extend through, a cylindrical opening 54 formed into the lower portion of the cam body 38. The bottom of spring 52 rests on the bottom surface of the cavity 40. The holding screw 30 is then threadily inserted into the bushing 50 to complete the basic cam lock assembly 20. Having the male element 24 on the cam lock assembly 20 and the female element 22 formed in the central bridge 18, rather than vice versa, allows the wall height of the cylindrical opening 54 to be at a satisfactory level, while minimizing the overall height of the cam-lock assembly 20. An internally threaded cylindrical cavity 55 in the cam body 38 provides for simple locking of the cam-lock assembly 20 to the bridge 18 by means of a locking screw 55A. The locking screw 55A carries a ball-type swivel head 55B, slightly larger in diameter than its screw, which in its unlocked position fits up into an enlarged diameter portion 55C of the cavity 55

Brief reference to the top view of base member 12 in FIG. 2B shows a centrally located slot 31 formed into the bridge portion 18 to accommodate the passge of workpiece engaging members which are carried by the cam-lock assembly 20, as well as the lower end of the bushing 50. The term workpiece engaging member(s) is used hereinafter to include the holding screw 30, its swivel head 36, or both of them. Note that the length of the slot 31 extends for a significant length along the bridge 18, terminating in arcuate extremities at each of its ends in the vicinity of the leg portions 14 and 16. Therefore, virtually all locations in the X-Y clamping plane may be accessed by the workpiece engaging members depending from the cam-lock assembly 20 through the slot 31.

This accessibility is illustrated by brief reference to FIGS. 6A–6D. As shown, workpieces having a range of cross-sections, such as square (26A), round (26B), and rectangular (26C and 26D) are readily accommodated. Full clamping plane coverage is suggested by the four simplified examples. Following the various adjustments of the holding screw 30, note in FIG. 6A that the screw 30 is centered in the X direction and is somewhat raised in the Y direction; in FIG. 6B it remains centered in the X direction but is lowered in the Y direction; in FIG. 6C its X position is shifted to the right of center, and it is somewhat raised in the Y direction; while FIG. 6D shows its X position shifted to the left of center and its Y position being somewhat lower. In FIG. 6D, notice that the swivel head 36' (the element which actually and literally contacts the workpiece) is smaller in size than those of the previous three illustrations. This feature allows the fullest use of the clamping plane by preventing collisions between the various adjustable elements and other structures in their vicinity. In like manner, and with momentary reference to FIG. 3, the bushing 50 and screw 30 may advantageously be provided as sets of elements having various predetermined lengths to further reduce the initial Y axis adjustment time for oversized, or undersized workpieces.

The deceptively simple assembly described above in connection with FIG. 3 is at the heart of the present invention as a number of significant benefits flow directly from the unique structures, relative positioning, and interaction of the elements described when used in combination with the other clamp and workpiece holding components previously described. Many of these benefits are closely interrelated and may, on first impression, appear to merge. However, a clear line of distinction can be drawn between them as detailed below. Basically, these benefits fall within four separate categories of: (1) enabling the rapid set-up of X-Y positioning of the workpiece engaging members at any point in the clamping plane; (2) positively engaging the workpiece and locking the X-Y position of the workpiece engaging member by a single cam actuation; (3) positively disengaging the workpiece for its rapid removal from the clamp by a single cam action; and (4) retaining the X-Y settings for rapidly engaging the next similar workpiece of the series to be machined.

Firstly, the present invention allows for rapidly establishing the desired X-Y position of the workpiece engaging members by a sliding/screwing action. X-axis positioning is done by simply sliding the cam-lock assembly 20 to the left or right as required. Fine X-axis adjustments are made virtually automatically by the action of the groove in the lower face of the swivel head 36 as the head 36 approaches contact with the workpiece. Y-axis positioning is done by simply advancing the length of the holding screw 30 by turning it, as described below in connection with FIG. 4. Coarse Y-axis positioning is provided by moving the cam lever 32 (or 32A) downward, as previously described. Note that this single downward actuation of the cam lever 32 accomplishes both the final X-axis setting, and the Y-axis coarse setting of the workpiece engaging members.

Secondly, the present invention enables the rapid and positive locking of the workpiece in its associated V-block, as well as locks the dovetail track X-axis sliding adjustment by the same single downward actuation of the cam lever 32. With the cam lever 32 raised to its open (fully upward) position, the spring 52 urges the bushing flange upward to lift the holding screw 30/head 36 sufficiently to readily insert the next in the series of workpieces to be machined. Upon lowering the cam lever 32 to its fully downward position, the multiple locking actions occur. Thus, the desired machining of the workpiece can proceed with significantly reduced set-up time.

Thirdly, the present invention enables the rapid disengagement of the workpiece from its associated V-block on completion of the desired machining steps also via a single operator manipulation. Mere lifting of the cam lever 32 causes the screw 30/head 36 to raise up by the camming distance, fully releasing the various locking forces and further providing the clearance needed for a friction free removal of the workpiece. Proper choice of the camming distance assures the accomplishment of both of these functions.

Fourthly, and possibly of signal importance, the present invention inherently preserves the precise X-Y settings for the workpiece engaging member initially set up, on completion of a machining operation and releasing of the cam level 32. (Dual locking means are used to preserve the X-axis settings.) This characteristic greatly facilitates the insertion of the next in the series of similar work pieces, thus further contributing also to the increased machining time and minimizing set-up (or resetting) time. As is well known in the commercial machining arts, any increase in the ratio of machining time to set-up time translates directly into increased man hour productivity, and so to lower unit production costs.

Therefore, it is clear that the above interrelated benefits, taken by themselves, or in combinations, provide a significantly improved clamping device for use with machining operations. The structures employed are straightforward; their interrelations are uniquely advantageous; and the resulting device produces significantly higher productivity in use, thus greatly increasing the competitiveness of machine shops engaged in carrying out repetitive machining steps on batches of similar input workpieces.

Referring to FIG. 4, a highly schematic view of selected components of the cam-lock assembly 20 is shown to illustrate the technique for rapidly adjusting the effective length of the holding screw 30. This may alternately be termed the manner for establishing the fine Y-axis setting for the workpiece engaging members. FIG. 4 includes both a side section, as well as top views of various related components. The cam lever 32 is shown in an intermediate position—neither fully down and locked, nor fully up and open—to accommodate the quick adjustment process. An interior cavity 56 within the cam lever 32 opens into the central cavity 40 within the cam body 38, to further communicate with the cylindrical opening 54. Alignment of these three open areas permits the insertion of a narrow shanked tool (not shown) along the axis a-a' to engage an allen head socket 58 formed into the top face of the holding screw 30. In use, this approach permits a quick and precise adjustment of the Y-axis setting as the screw 30 is either screwed upward into the bushing 50 (shown in FIG. 3) to shorten the setting, or screwed downward out of the bushing 50 to lengthen the setting. Advantageously, the initial Y-axis setting is done by firstly adjusting the screw 30 downward to place the groove in the swivel head 36 over the desired edge (or other portion) of the workpiece while the cam lever 32 is in its locked position. Then the cam lever 32 is moved to its partially open position allowing an additional amount of downward adjustment of the screw 30. Thereafter, the locking/unlocking/adjusting process may be repeated to achieve a desired positive holding force in the locked position for ease of workpiece removal.

An allen head socket 59 formed into the top face of the locking screw 55A allows its vertical adjustment for locking or unlocking purposes. Via a tool (not shown) inserted along an axis parallel to the a-a' axis, the lower extremity of the swivel head 55B may be adjusted raised to comfortably clear contact with the uppermost face of bridge 18, allowing the cam-lock assembly 20 to be freely adjusted as previously described. On adjustment of the locking screw 55A downward, the swivel head 55B, which may be made of teflon or other strong and resilient plastic, firmly bears on the uppermost face of the bridge 18 to retain the two assemblies in a locked position. With momentary reference to FIG. 4A showing a bottom view of the cam body 38, it is seen that the enlarged diameter portion 55C of the cavity 55 is positioned slightly off center. This allows the plastic swivel head 55B to bear against the uppermost face previously described for locking of the dovetail track members. Use of the locking screw 55B allows for a dual locking capability of the X-axis setting. When desired, the preset X-axis setting may be secured by means of the locking screw 55B for machining a series of identical workpieces.

Referring now to FIG. 5 there is shown an alternate embodiment of the rapid acting cam lock clamp wherein the base member is modified in shape for use with workpiece retaining means other than conventional V-blocks. Functionally, however, the embodiment of FIG. 5 performs virtuality identically to the embodiment of FIG. 1. The clamp 10' is configured with a modified base member 12' having spread apart leg portions 60 and 62 positioned at the ends of a central bridge portion 18'. Interior angles at the leg/bridge joint are obtuse, and the two leg portions form a 90 degree angle at their extremities so as to mate with a workpiece holding block 64 formed with two inside faces 66 and 68, also oriented at 90 degrees to each other. The leg portion 60 is retained in firm contact with the face 66 by means of a screw 70 which passes through an elongated slot 72 formed along the length leg 60. In like manner, the leg portion 62 is anchored to the face 68 via a screw 74 and an elongated slot 76.

Thereafter, the cam-lock assembly 20' is assembled to the bridge 18' as previously described such that the workpiece engaging members—screw 30/head 36—may adjustably bear on any workpiece held in the vertex between the two sides of block 64 having the end faces 66 and 68. Note that this alternate embodiment also includes a modification of the interior cavity 56' formed into the cam lever 32'. With momentary reference to FIG. 5A, and with direct comparison to the cam lever 32 shown in FIG. 4, note that the cavity 56' is basically cylindrical, allowing vertical adjustment of the holding screw 30 over a more limited range of cam lever 32 movement. In this embodiment the two pivot pins 46' each engage the dowel holes 44 on each side of the cam body 38.

Although the invention has been described in terms of selected preferred embodiments, the invention should not be deemed limited thereto, since other embodiments and modifications will readily occur to one skilled in the art. It is therefore to be understood that the appended claims are intended to cover all such modifications as fall within the true spirit and scope of the invention

What is claimed is:

1. A rapid acting adjustable clamp for controllably exerting clamping forces by a single cam actuated locking action, comprising:

(a) a base member having a leg at each of two ends of a central bridge member to enclose a clamping plane with orthogonal X and Y axes, said bridge member having a first type of dovetail track formed along one edge thereof;

(b) a slideable locking member having cam actuated locking means with locked and released positions, and having a second type of dovetail track formed along one edge thereof engaged with said first type of dovetail track for slidable X-axis adjustability along said bridge member;

(c) a workpiece engaging member carried by and threadedly depending from said cam actuated locking means for rotatable Y-axis adjustability;

(d) whereby said workpiece engaging member may be rapidly adjusted along said X-axis by moving said slideable locking member relative to said base member and said workpiece engaging member may be finely adjusted along said Y-axis by said rotatable adjustment, both with said cam actuated locking means in a released position, and said workpiece engaging member may be coarsely adjusted in part along said Y-axis by said cam actuated locking means, and said cam actuated locking means locking said dovetail engaged members in its locked position.

2. The clamp of claim 1 wherein said workpiece engaging member comprises an elongated externally threaded element threadedly engaged with said cam locking means, and includes a swivelly interconnected head at its workpiece contacting extremity.

3. The clamp of claim 2 wherein said cam locking means has an interior cavity extending therethrough at a location which allows said threaded element to be adjusted through said cavity when said cam locking means is in a predetermined position.

4. The clamp of claim 1 wherein said externally threaded element is a bolt of predetermined length to decrease the initial Y-axis adjustment time responsive to workpiece size.

5. The clamp 4 wherein said cam actuated locking means includes an internally threaded bushing for adjustably engaging said bolt, said bushing fitted within a coil spring and moveable along said Y-axis by a lever pivoted within said cam actuated locking means.

6. The clamp of claim 5 wherein said threaded bushing is cylindrical with a predetermined length to decrease the initial Y-axis adjustment time response to workpiece size.

7. The clamp of claim 6 wherein said cam locking means has an interior cavity extending therethrough at a location which allows said bolt to be adjusted through said cavity when said cam locking means is in a predetermined position.

8. A rapidly settable V-block clamp for exerting a highly repeatable clamping force on a succession of similar workpieces by a dual locking action, comprising:

(a) a base member having a leg at each of two ends of a central bridge member to enclose a clamping plane having first and second orthogonal axes, said bridge member having a first type of dovetail track formed along one edge thereof;

(b) A slideable locking member having a cam actuated locking means and a screw type locking means, each with locked and released positions, said slideable member having a second type of dovetail track formed along one edge thereof which is engaged with said first dovetail track for slideable adjustability along a first of said axes;

(c) a workpiece engaging member threadedly depending from said cam actuated locking means for rotatable adjustability along a second of said axes;

(d) a dovetail track engaging member threadedly depending from said screw type locking means for locking said engaged tracks in said first axis, and (e) whereby said workpiece engaging member may be rapidly adjusted along said first axis by moving said slideable locking member relative to said base member, and said workpiece engaging member may be finely adjusted along said second axis by said rotatable adjustability, and said workpiece engaging member may be coarsely adjusted along said second axis by said cam actuated locking means, and said cam activated locking means further locking said dovetail track engaged means in its locked position and retaining said rapid, coarse, and fine adjustment in its released position, and said screw type locking means further locking said dovetail track engaged means in its locked position and retaining said coarse and fine adjustment in its released position.

9. The clamp of claim 8 wherein said first and second axes are X and Y axes, respectively.

10. The clamp of claim 9 wherein said workpiece engaging member comprises an elongated externally threaded element threadedly engaged with said cam actuated locking means, and further includes a swivelly interconnected head at its workpiece contacting extremity.

11. The clamp of claim 10 wherein said externally threaded element is a bolt of predetermined length to decrease the initial Y-axis adjustment time responsive to workpiece size.

12. The clamp of claim 10 wherein said cam actuated locking means includes an internally threaded bushing for adjustably engaging said bolt, said bushing fitted within a coil spring and moveable along said Y-axis by a lever pivoted within said cam actuated locking means.

13. The clamp of claim 9 wherein said dovetail track engaging means comprise an elongated externally threaded element threadedly engaged with said slideable locking member.

14. The clamp of claim 13 wherein said cam locking means has an interior cavity extending therethrough at a location which allows said threaded element to be adjusted through said cavity when said cam locking means is in a predetermined position.

15. A rapid acting adjustable clamp for controllably exerting clamping forces by a single cam actuated locking action, comprising:

(a) a base member having a leg at each of two ends of a central bridge member to enclose a clamping plane with orthogonal X and Y axes, said bridge member having a first type of track element formed along one edge thereof;

(b) a slideable locking member having cam actuated locking means with locked and released positions, and having a second type of track element formed along one edge thereof engaged with said first type of track for slidable x-axis adjustability along said bridge member;

(c) a workpiece engaging member carried by and threadedly depending from said cam actuated locking means for rotatable Y-axis adjustability;

(d) whereby said workpiece engaging member may be rapidly adjusted along said X-axis by moving said slideable locking member relative to said base member and said workpiece engaging member may be finely adjusted along said Y-axis by said rotatable adjustment, both with said cam actuated locking means in a released position, and said workpiece engaging member may be coarsely adjusted in part along said Y-axis by said cam actuated locking means, and said cam actuated locking means locking said dovetail engaged members in its locked position.

16. The clamp of claim 15 wherein said slideable locking member includes a screw type locking means with locked and unlocked positions for locking said engaged tracks in said X-axis.

17. The clamp of claim 15 wherein said cam locking means has an interior cavity extending therethrough at a location which allows said threaded element to be adjusted through said cavity when said cam locking means is in a predetermined position.

18. The clamp of claim 15 wherein the first type of track element of said bridge member is a female dovetail track, the second type of track element of said slideable locking member is a male dovetail track element and said cam locking means has an interior cavity extending therethrough at a location which allows said workpiece engaging member to be adjusted through said cavity when said cam locking means is in a predetermined position.

19. The clamp of claim 18 wherein said slideable locking member has a screw type track locking means, including a track engaging element, with locked and unlocked positions, for locking said engaged dovetail tracks in said X-axis.

* * * * *